US006171471B1

(12) United States Patent
Ferrughelli et al.

(10) Patent No.: US 6,171,471 B1
(45) Date of Patent: Jan. 9, 2001

(54) HEAVY OIL UPGRADING PROCESS (LAW813)

(75) Inventors: David T. Ferrughelli, Flemington; Martin L. Gorbaty, Westfield, both of NJ (US)

(73) Assignee: Exxon Research and Engineering Company, Florham Park, NJ (US)

( * ) Notice: Under 35 U.S.C. 154(b), the term of this patent shall be extended for 0 days.

(21) Appl. No.: 09/302,622

(22) Filed: Apr. 30, 1999

(51) Int. Cl.[7] ..... C10G 67/04

(52) U.S. Cl. ..... 208/96; 208/212; 208/216 R; 208/251 R; 208/251 H; 208/253; 208/299; 208/309; 208/310 R; 208/311

(58) Field of Search ..... 208/58, 89, 96, 208/143, 251 R, 251 H, 253, 301, 302, 309, 311, 299

(56) References Cited

U.S. PATENT DOCUMENTS

| | | | | |
|---|---|---|---|---|
| 3,668,116 | * | 6/1972 | Adams et al. | 208/216 |
| 4,191,636 | * | 3/1980 | Fukui et al. | 208/110 |
| 4,525,267 | * | 6/1985 | Inooka | 208/58 |
| 4,591,426 | * | 5/1986 | Krasuk et al. | 208/96 |
| 4,750,985 | * | 6/1988 | Aldridge et al. | 208/53 |
| 4,954,240 | * | 9/1990 | Eidth, Jr. et al. | 208/50 |
| 5,362,382 | * | 11/1994 | Heck et al. | 208/210 |

* cited by examiner

*Primary Examiner*—Bekir L. Yildirim
(74) *Attorney, Agent, or Firm*—Ronald D. Hantman

(57) ABSTRACT

The present invention is a slurry-type process for upgrading heavy oils to FCC and S/C feeds under temperature and pressure conditions similar to MSHP, but employing catalysts in concentrations small enough (e.g., <300 ppm Mo on feed) that they need not be recycled.

16 Claims, 2 Drawing Sheets

HEAVY OIL UPGRADING PROCESS (LAW813)

BACKGROUND OF THE PRESENT INVENTION

The present invention relates to improving the quality of heavy feeds, ranging from crude oil to vacuum residua. In particular, the present invention makes acceptable feed for fluidized catalytic crackers from vacuum residua or other heavy feeds which are unsuitable due to high metals, sulfur or microcarbon residue (MCR).

Mild Slurry Hydroprocessing (MSHP) with finely divided catalyst can provide a flexible, relatively low cost means for improving the quality of heavy feeds, ranging from crude oil to vacuum residua. Currently the preferred catalyst for the hydroprocessing are Mo-based high surface area Microcat catalysts, however, other finely dispersed materials, including multimetallic compounds may also be used, so long as the quantity of metal is sufficient to keep the toluene insolubles level below 0.5%, and no more than the amount which can be disposed of economically.

MSHP operates at temperatures of about 725–825° F., the temperature dependent on oil residence time, with reactor pressures in the GOFINER range (800–1500 psig) with a captive bed slurry reactor. An important feature of this process scheme is the use of finely divided catalysts, and a critical limitation is the filtration and catalyst recycle system. Therefore, it is desirable to have an upgrading system that does not require a catalyst recycling.

SUMMARY OF THE PRESENT INVENTION

The present invention is a slurry-type process for upgrading heavy oils to Fluidized Catalytic Converter (FCC) and steam cracking (S/C) feeds under temperature and pressure conditions similar to MSHP, but employing catalysts in concentrations small enough (e.g., <300 ppm Mo on feed) that they need not be recycled. The process involves a) heating an oil at MSHP conditions using between 100–250 ppm of a preformed molybdenum based high surface area Microcat and b) subjecting the product from step 1 to a solvent deasphalting or adsorption step to remove metals and microcarbon residue (MCR). The deasphaltened oil is suitable as an FCC feed, and the lighter ends might be suitable for steam cracking. The bottoms may be sent to a coker or partial oxidation unit, etc. An advantage of such a once-through process is that it avoids the need for solids separation devices such as internal or external filters and for recycle of the separated solids. Runs at higher temperature at shorter residence times give similar product qualities to lower temperature, longer residence time products. Shorter residence times translate into smaller and lower investment.

DESCRIPTION OF THE PREFERRED EMBODIMENT

Mild Slurry Hydroprocessing (MSHP) is a technology which could provide a flexible, relatively low cost means for improving the quality of heavy feeds, ranging from heavy crude oils to vacuum residua for use in Gofining, Residfining, cat cracking, and steam cracking by reducing metals, MCR, and sulfur in resid. It seeks to capitalize on improved diffusion characteristics of small particle catalysts (e.g., 5–50 microns) relative to those used in fixed or moving bed processes. An MSHP process schematic is shown in FIG. 1.

Figure 1:
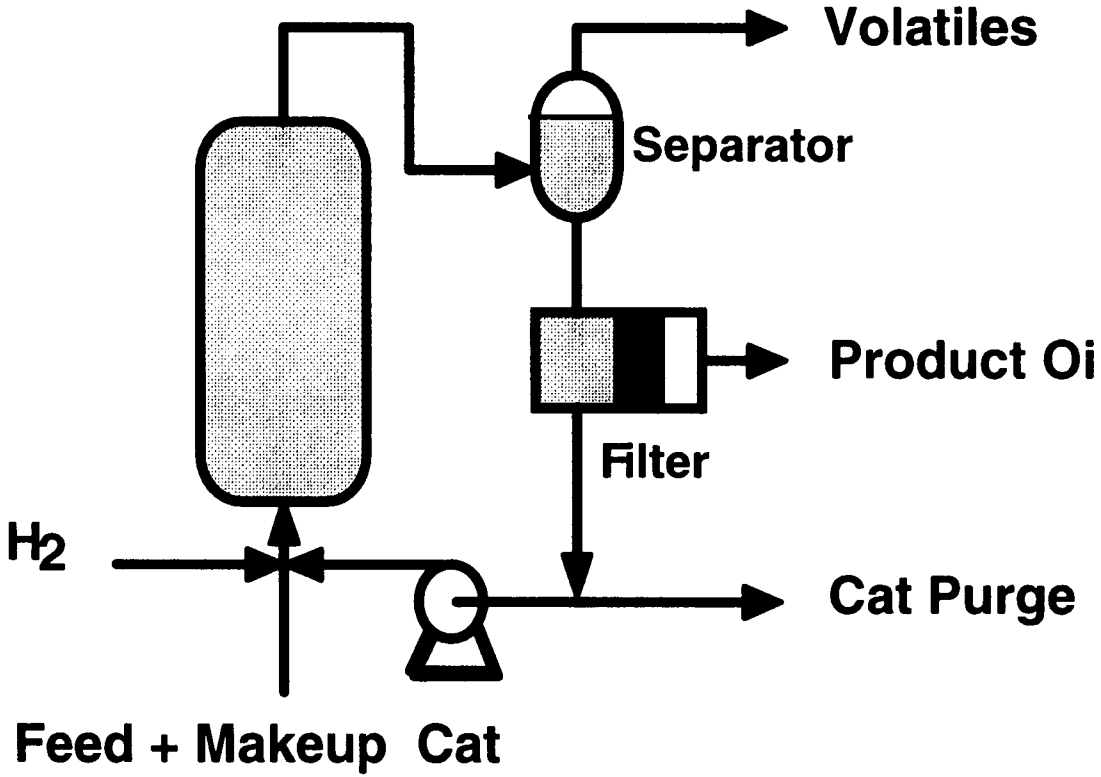
FIG. 1 shows a schematic diagram of a mild slurry hydroprocessing (MSHP) system.

FIG. 1 shows one possible process configuration for Mild Slurry Hydroprocessing (MSHP). In this embodiment, a pump-around slurry reactor is required. Feed, catalyst makeup and hydrogen are added to the reactor. The conversion reaction takes place in the captive bed of finely divided slurry catalyst at the appropriate temperature and pressure conditions for the appropriate time period. A solids-free product oil is withdrawn via an external cross-flow filtration vessel while the catalyst particles are sent back to the reactor. Provision is made for a purge stream of catalyst particles to be removed. This is one way to remove metals, deposited from the oil onto the catalyst surface, from the reactor. Other solids separation systems could be used instead of filters, such as hydroclones or centrifuges, to separate the converted oil from the slurry catalyst particles.

The MSHP process operates at reactor pressures in the GOFINER range (800–1500 psig) at about 725–875° F. with a captive bed slurry reactor. In a preferred embodiment, similar to the HCS reactor, reactor-internal filters are used to separate product oil from catalyst. Reactor-external separation devices include filters, centrifuges and hydroclones.

Solid separations using filters and other devices add significantly to the capital investment and operating costs of the MSHP process. One way to lower these costs would be to avoid the solid separation and recycling steps. Thus, a once-through process of the type described herein, which accomplishes demetallation and MCR reduction, without the need for separation and recycle of fine catalyst particles would lower costs of the process.

A process for making an acceptable FCC feed from vacuum residua or other heavy feeds which are unsuitable due to high metals, sulfur and MCR levels is disclosed herein. The process involves mild slurry hydrotreating of vacuum residua using a finely dispersed (slurry) heterogeneous catalyst containing metals levels at or below 300 ppm relative to feed. General process conditions range from temperatures of 725–850° F. and pressures from 800–1500 psig. Conditions for solvent deasphalting of the MSHP product oil will depend on the quality of product desired. A schematic diagram of the process is shown in FIG. 2.

Figure 2:
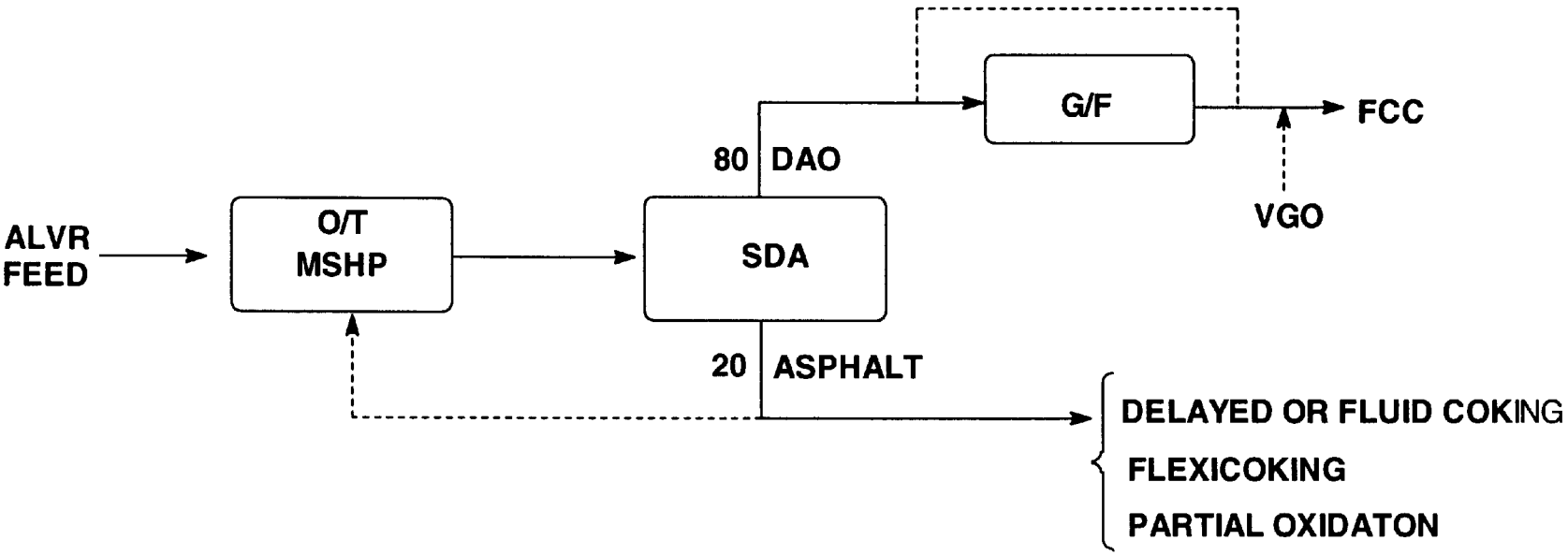
FIG. 2 shows a schematic diagram of a preferred embodiment of the present invention.

FIG. 2 shows one possible process configuration for once-through Mild Slurry Hydroprocessing (O-T MSHP). Feed, hydrogen, and finely dispersed catalyst particles containing no more than 300 ppm of metal by weight relative to the feed are fed into the reactor, which is designed in size for the appropriate temperature, pressure and time conditions. A large vessel is required for relatively low temperatures and long residence times, while a simple coil might suffice for a higher temperature, shorter residence time system. The product from the O-T MSHP is fed into a solvent deasphalter operated using a $C_3$, $C_4$, or $C_5$ paraffin, or combinations thereof, at about 135–150° C. at appropriate pressures and times to allow a separation to take place and reach equilibrium. The solvent deasphalted oil (DAO) may be sent to a fluid catalytic cracker (FCC), it may be blended with a virgin vacuum gas oil and sent to FCC, or it may be further upgraded in a gas-oil refining apparatus (GOFINER). The DAO product will be significantly lower in metals and will not poison GOFINER catalysts at the same rate as high metals feeds. The other product from SDA, the asphalt, is further converted into liquids by thermal processes such as coking, or converted into synthesis gas via partial oxidation ($PO_x$). As shown in the figure, it may also be desirable occasionally to recycle a portion of the asphalt, which contains catalytically active metals back into the OT-MSHP reactor.

As described above, deasphalted oil (DAO) from this process will, in general, be reduced in metals by about 95%, and show a significant reduction in MCR. The DAO may be sent directly to FCC, or blended with vacuum gas oil (VGO) before entering the FCC. If desired the DAO may be sent to a GOFINER to reduce MCR and sulfur further; the advantage is that the DAO will be low enough in metals that GOFINER catalyst life will be extended significantly. Many other combinations are possible based on the high quality of the DAO from the process. The asphalt from the solvent deasphalting will be sent to cokers to produce more liquids or to partial oxidation units ($PO_x$) for production of synthesis gas (CO and $H_2$). Optionally, a portion of the asphalt may be recycled into the OT-MSHP reactor.

Catalysts for the process may be made in several different ways, including in-situ decomposition of a soluble or dispersible inorganic or organic molybdenum compound in oil. Microcats are one example and may be used at a level of no more than 250 ppm Mo on feed. Other finely dispersed materials, including multimetallic compounds may also be used, so long as the quantity of metal is sufficient to keep the toluene insolubles level below 0.5%, and no more than the amount which can be disposed of economically. The catalysts may be sulfided with an $H_2S$ containing gas in-situ, or from the sulfur species contained in the feed. Catalyst may also be prepared ex-situ and added to the feed before entering the hydrotreater.

A general method for preparation of the catalyst is given in Example 1.

EXAMPLE 1

Catalyst Preparation

Catalyst for OT-MSHP was prepared by decomposing an aqueous dispersion of phosphomolybdic acid in Arabian Light Atmospheric reside (ALAR) in the presence of $H_2S$ and filtering it from the oil. An autoclave was charged with 70 g of ALAR, and the appropriate amount of a concentrate of phosphomolybdic acid dispersed in the oil, prepared separately, was added. The reactor was heated to 150° C., after which the autoclave was charged with 100 psig of $H_2S$ with stirring, and held at that temperature for 30 min. The autoclave was flushed out with hydrogen and heated to 320° C. under 1000 psig of static hydrogen. Hydrogen flow was started at 0.32 L/min as the autoclave was heated to 390° C. The mixture was stirred at these conditions for 1 hour. After cooling to about 150° C., the reactor was vented, and the contents filtered. The filtered solid was analyzed for molybdenum, and used as a catalyst in subsequent experiments. Herein it is designated as PMA/ALAR.

EXAMPLE 2

MSHP Procedure

A typical hydrotreating procedure involved charging an autoclave with 70 g of residuum, and the appropriate amount of PMA/ALAR catalyst, chosen on the basis of wt % metal on feed. The autoclave was flushed out with hydrogen and heated to 320° C. under 1000 psig of static hydrogen. Hydrogen flow was started at 0.32 L/min as the autoclave was heated to 410° C. or its final temperature. The mixture was stirred at these conditions for 2 hours. After cooling to about 150° C., the reactor was vented, and the contents filtered. The product oil was analyzed for Ni, V, sulfur, nitrogen and MCR.

EXAMPLE 3

Solvent Deasphalting Procedure

A typical solvent deasphalting experiment involved placing 1 g of oil in a flask, adding 10 ml of n-pentane, then stirring the mixture overnight at ambient temperature. The mixture was filtered, and the filtrate placed on a rotary evaporator to remove the n-pentane. The deasphaltened oil was analyzed for Ni, V, sulfur, nitrogen and MCR.

EXAMPLE 4

Demonstration of Demetallation and MCR Reduction

The procedure of Examples 2 and 3 were followed. The catalyst was PMA/ALAR, used at an amount equal to 0.64% Mo on feed Mo/Oil. The feed was Arabian Light Vacuum Resid (ALVR). After the first run, the filtered catalyst was used in four subsequent repeat cycles. Data for the product oils and the DAO's from the product oils from cycle 1 and cycle 5 are shown in Table 1.

TABLE 1

CONDITIONS: 411° C.; 1000 psi $H_2$; 2 h; PMA/ALAR Catalyst
ALVR FEED: 90 ppm V; 21.8% MCR; 30 ppm Ni
ALVR $C_5$ DAO YIELD: 80%; V in DAO: 28 ppm; 13.6 MCR; 7 ppm Ni

| | % Mo/Oil | Cycle # | % DAO Yield | MCR | Ni (ppm) | V (ppm) | % S | H/C |
|---|---|---|---|---|---|---|---|---|
| | 0.64 | 1 | | 15.4 | 10 | 14 | 2.91 | 1.51 |
| $C_5$ DAO | | | 87.9 | 8.7 | 1 | 1 | 2.68 | 1.56 |
| | 0.64 | 5 | | 15.8 | 17 | 32 | 2.99 | 1.49 |
| $C_5$ DAO | | | 86.1 | 7.8 | 2 | 2 | 2.73 | 1.55 |

Data from the first cycle show that product oil and its DAO contain significantly less Ni, V and MCR relative to the starting feed. The DAO shows almost complete demetallation. Data from cycle 5 show that the product oil contains more metals than the product oil from the first cycle, but the DAO from the cycle 5 product oil is virtually devoid of metals. Both DAO's have significantly less metals and MCR than the DAO prepared by the same procedure from the untreated ALVR. This surprising result suggests that during mild hydroprocessing the nature of the metal component has changed, making it more amenable to separation.

EXAMPLE 5

Once-Through MSHP/SDA Demonstration

MSHP and SDA experiments as described in Examples 2 and 3 were repeated using PMA/ALAR at the 100 and 250 ppm Mo on Oil level. Data from these experiments are shown in Table 2 along with the experimental conditions. The amount of vanadium in the MSHP products does not appear to be reduced very much from that of the starting oil (about 9 to 17%), but the DAO prepared from the MSHP product showed a greater than 90% reduction in vanadium. Similar results were obtained at 250 ppm of PMA/ALAR catalyst and a catalyst precursor made ex-situ from molybdenum acetonyl-acetonate (MoAcAc) supported on Ketjen Black (KB) carbon and sulfided in-situ. In both cases where catalyst was present, the % toluene insolubles was less than 1%. Without any added catalyst, a similar reduction in vanadium as for the catalytic runs is seen, however, the yield of DAO is less and the toluene insolubles are at least five times higher than those from the catalytic runs. In Table 2, toluene insolubles in the OT-MSHP product are shown in the column labeled % COKE (MSHP).

TABLE 2

CONDITIONS: 411° C.; 1000 psi $H_2$; 2 h and as shown
ALVR FEED: 90 ppm V; 21.8% MCR
$C_5$ DAO YIELD: 80%; V in DAO: 28 ppm; 13.6 MCR

| CATALYST | ppm Mo | RUN TIME (MIN) | ppm V MSHP OIL | % MCR MSHP OIL | % COKE (MSHP) | % YIELD $C_5$ DAO | ppm V DAO | % MCR DAO |
|---|---|---|---|---|---|---|---|---|
| NONE | 0 | 120 | 52 | 22.6 | 5.6 | 76 | 2 | 8.2 |
| PMA/ALAR | 100 | 120 | 75 | 19.8 | 0.9 | 81 | 4 | 8.5 |
| | 250 | 120 | 82 | 19.0 | 0.6 | 83 | 5 | 8.25 |
| | 100 | 30 | 99 | 21.7 | 0.0 | 80.5 | 9.8 | 10.67 |
| | 100 | 45 | 95 | 21.2 | 0.26 | 80 | 9.9 | 9.81 |
| | 250 | 30 | 90 | 20.5 | 0.0 | 83.2 | 13 | 11.12 |
| | 250 | 60 | 94 | 19.9 | 0.125 | 83 | 9 | 10.2 |
| MoAcAc/KB | 250 | 120 | 72 | 18.0 | 0.3 | 83.5 | 5 | 8.52 |

Data in Table 1 from Example 4 show that the MSHP product oils contain less vanadium than the MSHP product oils made at low catalyst concentrations. It is likely that there was sufficient surface area from the higher amounts of catalyst present for it to act as an adsorbent for the more polar metal species formed during the thermal treatment. Oils made in Example 5 likely did not have enough catalyst particles to adsorb or otherwise accommodate the altered metal species. Thus it is possible to use a selective adsorption instead of or in combination with a solvent deasphalting to remove metals and MCR from a once-through MSHP oil, and selective adsorption as one means of treating MSHP product oils to reduce metals and MCR is meant to be included in this invention.

Since the data indicate the key reaction is thermal, it is recognized that it should be possible to achieve the same product oil quality at similar thermal severities. This severity is a finction of residence time and temperature. For example, lowering the residence time at constant temperature lowers severity, while a given severity can be maintained by raising temperatures and lowering residence times. The incentive is to use a short residence time, since the shorter the time, the smaller the reactor size, and the lower the investment required.

Example 6 below illustrates the use of higher temperatures at shorter residence times to achieve substantially the same results as from a lower temperature, longer residence time experiment.

EXAMPLE 6

Demonstration of Higher Temperature/Shorter Residence Time

PMA/ALAR catalyst was prepared as in Example 1. The weight of catalyst used was such that wt % Mo on oil was equal to 250 ppm. The MSHP procedure was followed from Example 2 except that the temperature of the autoclave was raised to 425° C. and stirred for 30 minutes. The solvent deasphalting procedure from Example 3 was followed. The deasphalted oil was analyzed for Ni, V, sulfur, nitrogen, and MCR. Results are shown in Table 3, and are seen to be comparable to the results using the same catalyst, catalyst concentration and feed, except held for 411° C. for 2 hours (Table 2).

EXAMPLE 7

Demonstration of MSHP/SDA With Mo Precursor

This example illustrates a method for preparing a dispersed catalyst by using the residuum as sulfiding agent. The catalyst precursor was prepared by dissolving 6.8 g Molybdenum acetylacetonate (ACAC) in 50% methanol/50% toluene mixture. The dissolved precursor was then added dropwise with stirring into 100 g Arab Light Atmospheric Resid which was heated to 55° C. After all the precursor was added the solvent was removed by roto evaporation. The resulting ICP analysis of the oil showed a Mo concentration of 1.75%. The MSHP run was carried out by following the MSHP procedure of Example 6, except that the catalyst was added as 1 g of the MoAcAc/ALAR mixture into 70 g ALVR to give a wt % Mo concentration of 250 ppm on oil. No $H_2S$ was used to sulfide the catalyst for this run. The solvent deasphalting procedure from Example 3 was followed. The deasphalted oil was analyzed for Ni, V, sulfur, nitrogen, and MCR. Results are shown in Table 3, and indicate active catalysts can be made at low metals level using feed as sulfiding agent.

TABLE 3

CONDITIONS: 425° C.; 1000 psi $H_2$
ALVR FEED: 90 ppm V; 21.8% MCR
$C_5$ DAO YIELD: 80%; V in DAO: 28 ppm; 13.6 MCR

| CATALYST | ppm Mo | RUN TIME (MIN) | ppm V MSHP OIL | % MCR MSHP OIL | % COKE (MSHP) | % YIELD $C_5$ DAO | ppm V DAO | % MCR DAO |
|---|---|---|---|---|---|---|---|---|
| PMA/ALAR | 250 | 30 | 90 | 20.06 | 0.52 | 81.3 | 5 | 9.41 |
| MoAcAc/ALAR | 250 | 30 | 83 | 18.32 | 0.45 | 83.4 | 5 | 9.03 |

What is claimed is:

1. A process to reduce the amount of metals and microcarbon residue in a hydrocarbon-containing feedstream comprising:

(a) mild-slurry hydrotreating said feedstream in a single stage at a temperature and pressure for a sufficient time using a heterogeneous catalyst at metal levels at or below 300 ppm by weight relative to feed, and then directly (b) reducing said metals and said microcarbon residue from the hydrotreated product in a solvent deasphalter.

2. The process of claim 1 wherein said hydrotreating step is performed at a temperature between 725 and 850° F.

3. The process of claim 1 wherein said time is between 5 minutes and 4 hours.

4. The process of claim 1 wherein said hydrotreating step is performed at a pressure between 800 and 1500 psig.

5. The process of claim 1 wherein said metal catalyst levels are between 100 and 300 ppm by weight based on feed.

6. The process of claim 1 wherein said metal catalyst is a molybdenum based catalyst.

7. The process of claim 1 wherein said reducing step is performed by selective adsorption.

8. The process of claim 1 wherein said catalyst is prepared in-situ by contacting feed with phosphomolybdic acid.

9. The process of claim 8 wherein said contacting step is performed at a temperature of about 150° C. and for a time of about 30 minutes.

10. The process of claim 9 further comprising a sulfiding step at a temperature of about 390° C. for a time of about 1 hour.

11. The process of claim 1 wherein said catalyst particle size is between 5 and 50 microns.

12. The process of claim 1 wherein said solvent deasphalter is operated using a $C_3$, $C_4$, or $C_5$ paraffin or combinations thereof.

13. The process of claim 1 wherein a portion of the asphalt recovered from the solvent deasphalter is recycled to the OT-MSHP reactor.

14. The process of claim 1 wherein said catalysts are prepared and sulfided in-situ.

15. The process of claim 1 wherein catalyst precursors and catalyst are prepared ex-situ and added to the feed.

16. The process of claim 1 wherein the OT-MSHP reaction is carried out at a temperature of about 425° C. for a time of about 30 minutes.

* * * * *